US005695165A

United States Patent [19]

Moriarty

[11] Patent Number: 5,695,165

[45] Date of Patent: Dec. 9, 1997

[54] MULTI-MODE ATTACHABLE HANGER FOR PIPETTES

[75] Inventor: Kent Gordon Moriarty, Pinole, Calif.

[73] Assignee: Rainin Instrument Co., Inc., Emeryville, Calif.

[21] Appl. No.: 581,346

[22] Filed: Dec. 29, 1995

[51] Int. Cl.[6] ..... A47F 5/00

[52] U.S. Cl. ..... 248/316.8; 248/206.5; 248/205.4

[58] Field of Search ..... 248/205.3, 206.5, 248/231.91, 316.2, 316.7, 316.8, 312, 314, 309.1, 111, 205.4

[56] References Cited

U.S. PATENT DOCUMENTS

| | | | |
|---|---|---|---|
| D. 150,507 | 8/1948 | McEntire | 248/316.8 X |
| D. 296,520 | 7/1988 | Spinetta | 248/312 X |
| 825,332 | 7/1906 | Mack | 248/316.7 X |
| 1,268,154 | 6/1918 | Root | 248/206.5 X |
| 1,561,554 | 11/1925 | Little | 248/206.5 X |
| 1,718,316 | 6/1929 | Swenson | 248/316.7 |
| 1,989,436 | 1/1935 | Weigand | 248/312 |
| 2,248,916 | 7/1941 | Opper | 248/316.7 X |
| 2,644,212 | 7/1953 | Markowitz | 248/206.5 X |
| 3,913,876 | 10/1975 | McSherry | 248/205.3 X |
| 4,961,555 | 10/1990 | Egan, Jr. | 248/314 X |

FOREIGN PATENT DOCUMENTS

| | | | |
|---|---|---|---|
| 2029696 | 3/1980 | United Kingdom | 248/316.8 |

OTHER PUBLICATIONS

VWR Scientific Catalog, 1994–1995, pp. 997, 999.

Fisher Catalog, 1993–1994, pp. 1219, 1246.

PGC Scientifices Catalog, Winter 1994, p. 84.

PGC Scientics Catalog, Summer 1995, pp. 68, 69.

PGC Scientifics Catalog (Racks and Supports) 1994 pp. 32, 33.

Thomas Scientific Catalog, 1991–1992, p. 1012.

Cole–Parmer Catalog, 1993–1994, pp. 257, 259–262.

*Primary Examiner*—Ramon O. Ramirez
*Assistant Examiner*—Stephen S. Wentsler
*Attorney, Agent, or Firm*—Robert R. Meads

[57] ABSTRACT

A multi-mode attachable hanger for a pipette comprising contiguous mounting and pipette supporting portions. The supporting portion comprises a pair of substantially parallel, laterally separated support arms extending forward from a back plate to vertically support a pipette body there between. The mounting portion comprises a spacer extending rearward from the back plate spacing the back plate from a support surface to which the hanger is to be mounted. A connector extends from the spacer to secure the hanger to the support surface with the rear edge surface bearing against the support surface. The connector is characterized by means for securing the hanger to a ferrous surface, a hollow wall, a wooden surface, and in combination comprises one or more of a magnet, screw of adhesive centered with respect to the spacer.

4 Claims, 4 Drawing Sheets

MULTI-MODE ATTACHABLE HANGER FOR PIPETTES

FIELD OF INVENTION

The present invention relates to pipettes for precisely dispensing measured quantities of fluids and, more particularly, to apparatus for supporting such pipettes when not in use by hanging the pipettes from a variety of surfaces including any ferrous surface such as a fume hood or refrigerator or metal cabinet door, or any hollow wall or wooden surface, or the edge of any counter top, shelf, or table top.

BACKGROUND OF INVENTION

In order to repeatedly dispense measured quantities of liquid in clinical and diagnostic laboratories, it is common today to utilize manual and electronic pipettes. In use, a technician grasps the body of a pipette and places a removable tip end thereof in the fluid to be aspirated and dispensed by the pipette. The technician either allows manual or motor actuated movement of a piston within the body of the pipette to draw a measured quantity of liquid into the pipette tip. The technician then reverses the movement of the piston to dispense a precise quantity of liquid into a receptacle. When the dispensing operation is complete, the removable tip is ejected from the pipette and a new tip inserted onto the tip end of the pipette.

When the pipette is not in use, it is usually placed on a counter or bench top or in a drawer of a table or on a shelf in the laboratory where the pipette is normally used. Because it is important to avoid damage to the delicate mechanisms comprising the pipette and to maintain the pipettes in close proximity to the technician for ready access for operation, various racks, stands, and carrousels have been developed for supporting pipettes on table and counter tops and even by hanging on walls.

Typical of the pipette stands are the "Pipettor Stand/Work Station" model 290-002 and "Pipettor Stand" model 290-001 of PCG Scientifics, Gathersburg, Md., and the "Scienceware Micropipettor Racks" catalog numbers 14-791-8A and 14-791-8D from Fischer Scientific of Pittsburgh, Pa. The Pipettor Stand-Work Station comprises a small cabinet for resting on a table or counter top. A top of the cabinet includes a plurality of openings for each vertically receiving a lower body portion of a pipette to support a series of pipettes when not in use. The Pipettor Stand includes a flat base for resting on a table or counter top and a sloping back carrying upper and lower support arms with vertically aligned front facing notches for receiving and supporting the main bodies of a plurality of pipettes. The Scienceware Micro Pipettor Racks include an L-shaped base for resting on a table or counter top with an upper lateral flange containing a series of top openings for receiving the lower body portion of a plurality of separate pipettes.

Typical of the wall mounted racks are the "Magnetic Pipet Holder" model 290-009 and the "Wall Mounted Pipettor Rack" models 01-024 and 01-026 of PCG Scientifics. The Magnetic Pipet Holder includes a flat support plate carrying a magnetic strip for attaching the support plate to a metal surface. Upper and lower arms extend forward from the support plate and include vertically aligned notches for receiving and supporting a plurality of pipettes. The Wall Mounted Pipettor Racks comprise metal racks with round or key-hole shaped top opening holes for vertically receiving and supporting a number of pipettes. The racks are attachable to a wall by screws or by double-sided tape.

Typical of a pipette carousel stand are the "Carousel Pipettor Stand" model 02-254 of PCG Scientifics and the "Carousel Pack GR-2" of the Rainin Instrument Co., Inc., the assignee of the present invention. Such pipette carousels include a base and a vertically extending pole with outwardly extending arms with notches for receiving and supporting a plurality of pipettes.

Each of the foregoing stands, racks and carousel pipette holders serve a useful purpose. However, they are each specially designed for a particular support setting. The stands, racks and carousel structures are designed for supporting a plurality of pipettes on a counter or a tabletop. The Magnetic Pipette Holder is specifically designed for attachment to a metal surface. The wall mounted racks are designed for attachment to a flat wall surface by screws or tape.

None of the foregoing pipette holders is designed to provide multiple modes of attachment to the various support surfaces commonly found in clinical and diagnostic laboratories such as the vertical front surfaces of refrigerators, cabinet doors, or fume hoods (all of which are usually formed of a ferrous material), or hollow walls or wooden surfaces or the edges of shelves or table tops. Accordingly, there is a need for a simple and inexpensive support apparatus for securely and safely supporting pipettes when not in use and which possesses the ability of attachment in a number of different manners to a number of different surfaces typically found in laboratory settings. The present invention satisfies such needs.

SUMMARY OF INVENTION

The present invention provides a multi-mode attachable hanger for pipettes comprising contiguous mounting and pipette supporting portions. The supporting portion comprises a pair of substantially parallel, laterally separated support arms extending forward from a back plate for vertically supporting a pipette body there between. Preferably, the support portion is formed of a plastic material. The mounting portion comprises a spacer means extending rearwardly from the back plate for spacing the back plate from a support surface to which the hanger is to be mounted. Preferably, the spacer means forms a magnet housing having an open back and a rear edge surface (or surfaces) in a common plane facing the support surface. The hanger further comprises connector means extending from the spacer means to secure the hanger to the support surface with the rear edge surface of the spacer bearing on the support surface.

In a most preferred embodiment of the present invention the connector means accommodates connection of the hanger to (i) any ferrous surface such as a fume hood, refrigerator door or cabinet door, (ii) any non-ferrous or wooden surface or (iii) the edge of any shelf or table top. In that regard, in the most preferred embodiment, the connector means comprises a flat ring-shaped magnet secured within an annular metal shroud defining the spacer means and having a continuous rear facing edge in the common plane. The shroud preferably comprises an annular flange extending rearward from a metal support plate centrally located on and secured to a back of a back plate. A front face of the ring-shaped magnet is secured to the metal support plate with a rear face of the magnet substantially in the common plane to secure the hanger to any ferrous surface. Preferably, the connector means further includes a hole passing through the back plate between the support arms and further passing through the metal support plate concentric with the ring-shaped magnet to receive a screw for securing the hanger to a hollow wall or wooden or metal surface. The connector means also preferably comprises a double sided adhesive strip releasably secured to the rear face of the magnet to secure the hanger to any non-ferrous support surface by adhesive means. Thus, in the most preferred embodiment of the present invention, the hanger may be secured to a support surface by magnetic attraction to a ferrous surface or by adhesive bonding or by screw connection to any support surface.

In another preferred embodiment of the present invention, the hanger comprising the support and mounting portions is fixed to a vertical side of a channel frame also including a top and a bottom member. The channel is shaped to receive the edge of a support member such as a shelf or counter or table top. The hanger further includes hand adjustable screws extending through the bottom side of the channel to engage an underside of the support member to secure the channel and hence the hanger to the edge of the support member. In such a preferred embodiment of the hanger, a plurality of hangers may be secured in a side by side arrangement to the vertical side of the channel in order to individually and vertically support a series of pipettes along the vertical side of the channel.

DETAILED DESCRIPTION OF INVENTION

FIGS. 1 through 6 depict a multi-mode attachable hanger 10 for supporting a single pipette 20. By way of example only, the pipette 20 is a manual pipette of the type described and illustrated in U.S. Pat. Nos. 3,827,305 and 3,991,617, sold under the trademark PIPETMAN exclusively in United States by the Rainin Instrument Co. Inc., the assignee of the present invention.

In accordance with the present invention, the hanger 10 possesses the ability to attach to a variety of support surfaces commonly found in clinical and diagnostic laboratories. For example, the hanger 10 is capable of attaching by magnetic attraction to any ferrous surface such as the surface of a fume hood or the front face of a refrigerator or metal cabinet. Alternatively, the hanger 10 may be attached by an adhesive to a non-metallic surface such as a cabinet door, drawer, or wall. Further, the hanger 10 may be secured by a screw to a hollow wall or any other vertically extending wood or metal surface. In each instance, the hanger 10 supports the pipette 20 by hanging in a vertical direction for ready access to a technician when the technician desires to place the pipette in operation. Following such operation, the technician merely hangs up the pipette 20 on the hanger 10 at a location adjacent to the technician's work station. Thus, in its appropriately basic form, the hanger 10 is most characterized as a multi-mode attachable hanger for pipettes.

Figure 2:
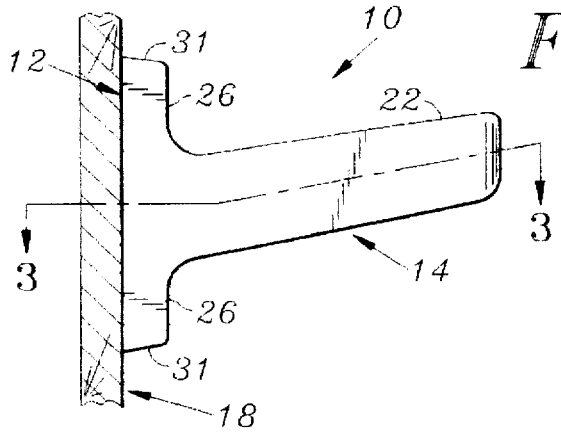
FIG. 2 is a side view of the hanger illustrated in FIG. 1 connected to the flat wall but without the pipette.
Figure 3:
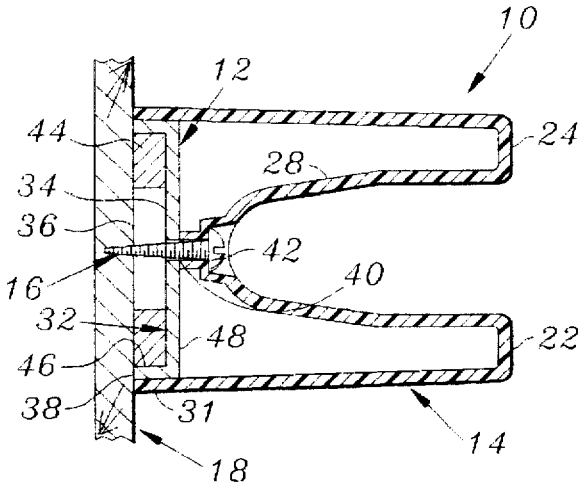
FIG. 3 is a sectional top view along the line 3—3 in FIG. 2.
Figure 1:
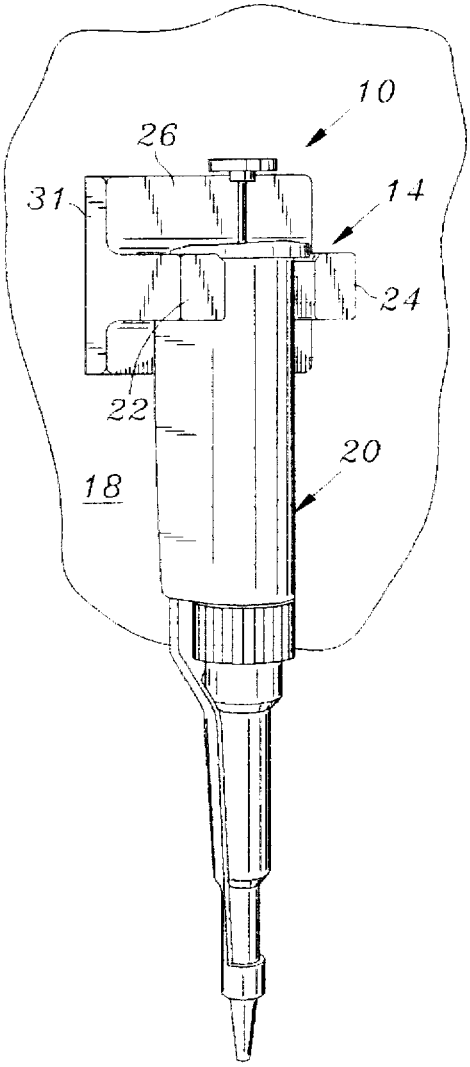
FIG. 1 is a perspective view of one embodiment of the hanger of the present invention including a support portion supporting a manual pipette and a mounting portion attached to a support surface comprising a flat wall.
Figure 4:
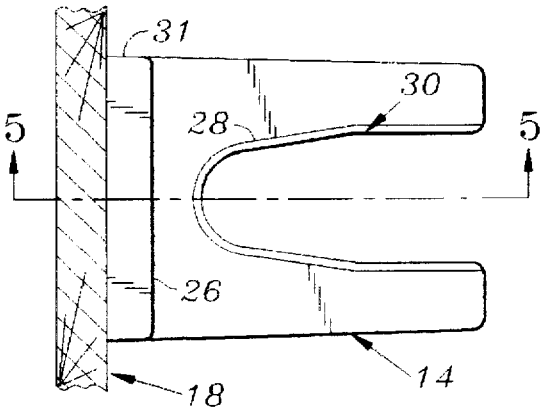
FIG. 4 is a top view of the hanger shown in FIG. 2.
Figure 5:
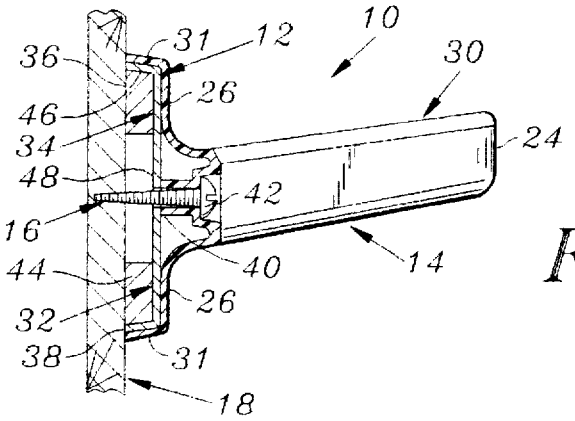
FIG. 5 is a sectional side view along the line 5—5 in FIG. 4.
Figure 6:
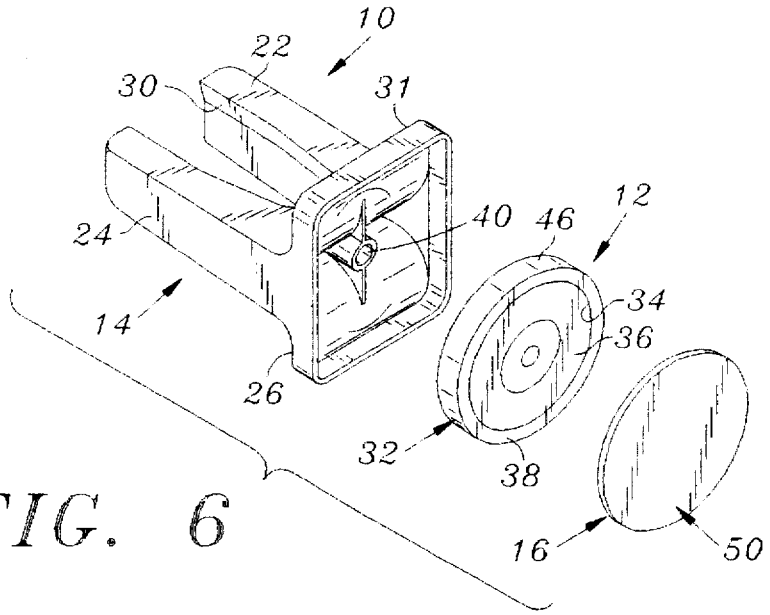
FIG. 6 is a perspective and exploded rear view of the hanger of FIG. 1 showing a hollow housing and a rear of the hanger for receiving a ring-shaped magnet confined in an annular shroud, and a double-sided adhesive disc.

Basically, with reference to FIGS. 1 through 6, the hanger 10 comprises contiguous mounting and pipette supporting portions 12 and 14 and a connector 16 for securing the hanger to a support surface 18. Preferably, the support portion 14 is formed of a plastic material and comprises a pair of substantially parallel, laterally separated hollow support arms 22 and 24 extending forward from a back plate 26 for vertically supporting the pipette 20 between the arms 22 and 24. In this regard, the arms 22 and 24 connect to the back plate 26 and to each other at a "C" shaped section 28 which extends vertically between the arms. Further, the arms 22 and 24 and C-shaped section 28 extend forward from the back plate 26 and slightly upward from a horizontal plane, for example at an angle of about 8 degrees. Further, the upper inner edges of the arms 22 and 24 and the C-shaped section 28, are beveled as indicated at 30. This allows the technician to simply hang the pipette 20 on the arms 22 and 24 with the arms extending on opposite sides of the body of the pipette and with an upper surface of the arms and C-shaped section 28 firmly supporting a flange extending outwardly from the main body of the pipette as illustrated in FIG. 1.

As illustrated in FIGS. 2 through 6, the plastic support portion 14 of the hanger 10 includes a decorative flange 31 extending rearwardly from and circumscribing an outer edge of the back plate 26 to confine the mounting portion 12 of the hanger. In this regard, the flange 31 combines with the back plate 26 to form an open back housing for the mounting portion. As illustrated, the mounting portion 12 of the hanger 10 preferably includes a rigid metal spacer 32 extending from the back plate 26 for (i) spacing the back plate 26 from the support surface 18 on which the hanger is mounted, (ii) reinforcing the plastic support portion 14 of the hanger 10 and (iii) preventing any deformation of the back plate 26 and flange 31 as the hanger is connected to the support surface. In this regard, the spacer 32 may comprise a plurality of rigid arms extending from the back plate 26. However, as illustrated, the spacer 32 preferably comprises a rigid annular flange 46 forming a shroud extending rearward from a circular metal support plate 48 and combining therewith to form a housing 34 having an open back 36 and an annular rear edge surface 38 in a common plane for engaging the support surface 18 when the hanger 10 is mounted on the support surface. The spacer 32 including the support plate 48 and annular flange 46 are centrally located within the housing 34 with a front face of the support plate secured to a back face of the back plate. Preferably, the spacer 32 is secured to the back plate 26 by an adhesive, such as CA 100, a cyanoacrylate adhesive of 3M Company, St. Paul, Minn. In addition to the adhesive, the support plate 48 may be secured to the back plate 26 by a 8–32×½ inch stainless steel screw and nut (not shown). In such an arrangement the screw extends through an opening 40 through the C-section 28 and the back and support plates 26 and 48 between the arms 22 and 24 to receive the nut bearing against the back face of the support plate.

In order to provide the multi-mode attachment feature of the hanger 10, the connector 16 preferably includes a plurality of different connection mechanisms. In the embodiment illustrated in FIGS. 2 through 5, the stainless steel screw and nut are removed and the connector 16 comprises a horizontally extending screw 42 in the opening 40 through the C-section 28 and the back and support plates 26 and 48. The screw 42 has an enlarged head engaging an annular shoulder surrounding the opening 40 in the C-section 28. The screw is adapted by manual turning to screw into a hollow wall, or any wood or metal surface to fix the hanger 10 to the support surface 18. Being between the arms 22 and 24 and through the C-section 28, the screw extends through a central portion of the housing 34 to develop a uniform attaching force between the hanger 10 and the support surface 18, the rear edge surface 38 of the annular flange 46 being uniformly spaced from the opening 40 and screw 42 and hence the point of application of the attaching force of the hanger 10 to the support surface. Thus constructed, the reactive forces from the support surface 18 are directed against the rigid metal flange 46 and support plate 48 rather than the relatively flexible and deformable plastic back plate 26 and flange 31.

To provide a similar attachment of hanger 10 to the support surface 18 when the support surface is formed of a ferrous material, the connector 16 preferably comprises a flat ring-shaped magnet 44 centered within the annular shroud 46 and the housing 34. Preferably, a front face of the ring-shaped magnet 44 is secured to a back face of the support plate 48 by an adhesive, such as Pllobond adhesive available from W. J. Ruscoe, Akron, Ohio. Thus, the annular shroud 46 provides confinement and protection for the outer edge of the magnet 44 with the rear face of the magnet 44 of the magnet 44 lying substantially in the common plane defined by the rear edge surfaces 38 of the shroud. The shroud 46, being preferably formed of a metal also serves to focus the magnetic field of the magnet 44 to enhance the attachment of the hanger to a ferrous surface. Accordingly, to mount the hanger 10 to a ferrous surface, the user simply tilts the hanger slightly so that one edge of the magnet 44 touches the ferrous surface and then eases the magnet onto the surface. If it is ever desired to remove the hanger from the ferrous surface, the process is simply reversed with the hanger being tilted to tilt the magnet 44 relative to the ferrous surface. The magnet is then pulled from the ferrous surface.

If desired, a protective covering may be provided over the magnet 44 as an option (not shown). However, when the support surface 18 as other than a ferrous material and it is desired to mount the hanger 10 to such a support surface, the connector 16 further comprises a disc-shaped adhesive strip 50 preferably in the form of a double-backed tape having a protective covering on its front and rear surfaces as shown most clearly in FIG. 6. Preferably, adhesive strip 50 is dimensioned to cover the rear face of the magnet 44 and the rear edge surface 38 of the annular flange 46 and to attach thereto after the protective cover is removed from a front face of the adhesive strip. Then, to secure the hanger 10 to a non-ferrous wood or plastic surface, the user simply removes the protective cover from the rear face of the adhesive strip 50 and presses the hanger firmly against the support surface. After suitable curing, the hanger 10 is fixed to the support surface and is ready to support the pipette 20 as depicted in FIG. 1.

Figure 8:
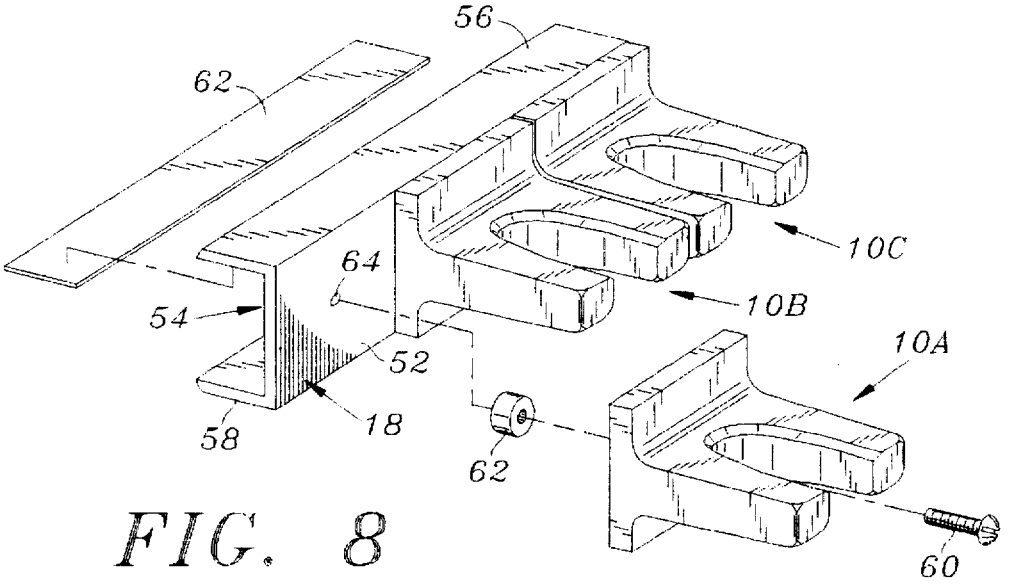
FIG. 8 is a front perspective view, partially exploded, showing the hanger apparatus of FIG. 7.
Figure 7:
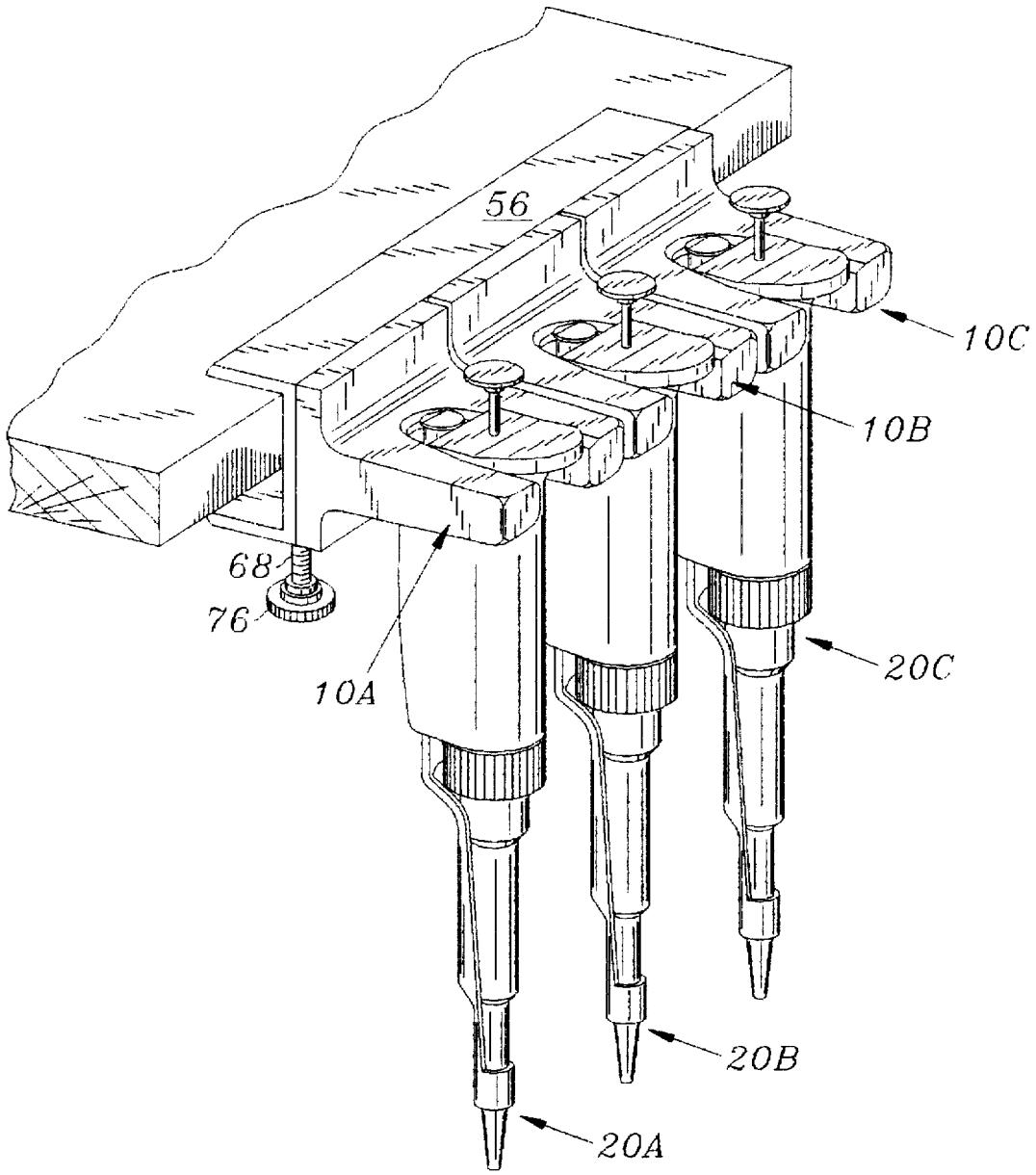
FIG. 7 is a perspective view of a second preferred embodiment of the present invention including a channel frame for supporting a plurality of hangers each supporting a different pipette.
Figure 9:
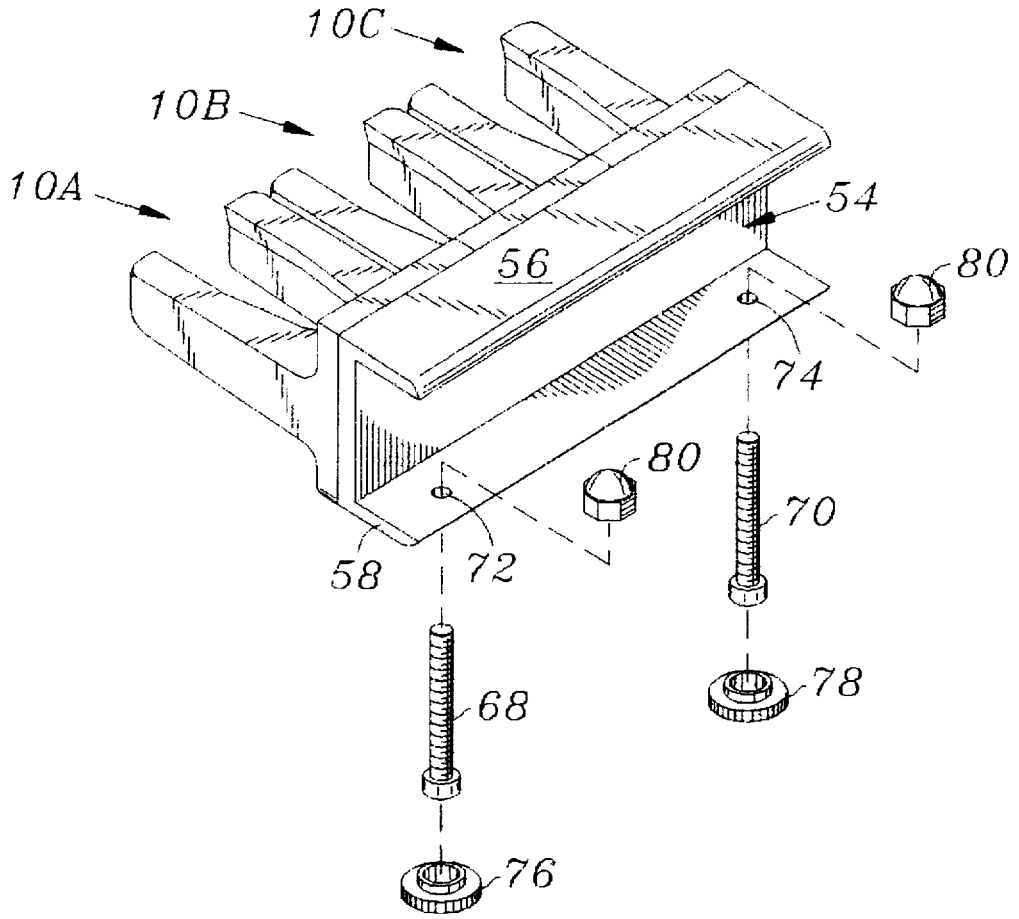
FIG. 9 is ar rear perspective view, partially exploded, of the hanger apparatus of FIG. 8.

The embodiment of the present invention illustrated in FIGS. 7, 8 and 9 is designed to support a plurality of pipettes on the edge of a shelf or table or similar support surface. In this regard, as depicted in such figures, the hanger comprises three separate hangers similar to the previously described hanger 10 and designated by the numbers 10A, 10B and 10C supporting pipettes 20A, 20B and 20C respectively. The support surface 18 to which the hangers 10A, 10B and 10C are connected comprises a vertical side 52 of an extruded aluminum, C-shaped channel frame 54 having substantially parallel elongated top and bottom sides 56 and 58 respectively. The hangers 10A, 10B and 10C are secured to the vertical side 52 of the channel frame 54 by screws 60 extending through the openings 40 (not shown) in each of the hangers and spacing washers 62 into threaded holes 64 in the side 52 as shown most clearly at FIG. 8. Thus supported, the hangers 10A, 10B and 10C are immediately adjacent each other in a side by side pattern to vertically support the pipettes 20A, 20B and 20C as shown in FIG. 7.

To secure the hangers to the edge of a shelf or table or the like, the channel frame 54 is dimensioned to receive the edge of the shelf within the open C-channel. A resilient strip 62 secured by adhesive to an underside of the top 56 of the channel engages the top edge of the shelf to provide a cushioning for the channel on the shelf. The connection of the channel to the shelf is by hand adjustable screws 68 and 70 which pass upwardly through threaded bottom holes 72 and 74 in the bottom side 58 of the channel frame as indicated in FIG. 9. The lower end of each of the screws is enlarged as indicated at 76 and 78 for hand turning and the upper end of each of the screws supports a nut 80 for engaging the underside of the shelf to which the channel is to be attached. Thus, in order to support the hanger apparatus of FIGS. 7–9 on the edge of a shelf, a technician simply adjusts the screws 68 and 70 to open the channel frame 54 and places the channel over the edge of the shelf. The technician then turns the screw 68 and 70 until the nuts 80 engage the under surface of the shelf thereby fixing the channel 54 and hence the hangers 10A, 10B and 10C to the edge of the shelf to provide hanging support for the pipettes 20A, 20B and 20C.

While particular embodiments of the present invention have been illustrated and described herein, it is appreciated that changes and modifications may be made in the illustrated embodiments without departing from the spirit of the present invention which is to be limited in scope only by the terms of the following claims.

I claim:

1. A multi-mode attachable hanger for a pipette, comprising:

a plastic pipette support comprising a pair of substantially parallel, laterally separated pipette supporting arms extending forward from a back plate, and a flange extending rearwardly from and circumscribing an outer edge of the back plate to define an open back housing;

a pipette support reinforcing and hanger mounting structure within the open back housing comprising a metal support plate having a front face secured to the back plate of the plastic pipette support and a metal flange forming a magnetic field confining shroud extending rearward from the metal support plate;

a magnet secured to the metal support plate within the shroud for magnetically attaching the hanger to a separate support surface of ferrous material; and openings in the magnet, metal support plate and back plate, the openings being designed to receive a screw for screwing into and attaching the hanger to a separate support for the hanger.

2. The hanger of claim 1 further comprising an adhesive strip secured to the metal flange over a rear face of the magnet.

3. The hanger of claim 1 wherein the shroud is an annular shroud and the magnet is ring-shaped magnet.

4. The hanger of claim 3 wherein a rear edge of the shroud and a rear face of the magnet lie in a common plane.

* * * * *